US006364385B1

(12) United States Patent
Steward et al.

(10) Patent No.: US 6,364,385 B1
(45) Date of Patent: Apr. 2, 2002

(54) BOTTLE HANDLE AND CARRY ASSIST DEVICE

(75) Inventors: Sterling Lane Steward, Douglasville; Marshall J. Barrash, Atlanta; Lawrence B. Green; Christopher Clark Kjorlaug, both of Alpharetta, all of GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/487,098

(22) Filed: Jan. 19, 2000

(51) Int. Cl.[7] ..... B65D 23/10

(52) U.S. Cl. ..... 294/27.1; 294/31.2; 215/396

(58) Field of Search ..... 294/25, 27.1, 31.2, 294/33, 137, 145; D9/434, 435, 443; 215/396, 398; 220/758, 759

(56) References Cited

U.S. PATENT DOCUMENTS

| | | | | |
|---|---|---|---|---|
| 2,154,581 A | | 4/1939 | Pershall | |
| 2,597,474 A | * | 6/1952 | Alex | 294/27.1 |
| 2,610,081 A | * | 9/1952 | Bushman | 24/33 |
| 3,088,767 A | | 5/1963 | Deal | |
| 3,171,574 A | * | 3/1965 | Simms | 294/27.1 |
| 3,185,515 A | * | 5/1965 | Marler | 294/27.1 |
| 3,232,495 A | | 2/1966 | Schneider | |
| 3,307,752 A | | 3/1967 | Anderson | |
| 3,347,401 A | | 10/1967 | Nataf | |
| RE29,708 E | | 7/1978 | Schlegel | |
| 4,273,246 A | * | 6/1981 | Thompson | 215/396 |
| 4,280,630 A | * | 7/1981 | Hafele | 215/396 |
| 4,456,135 A | | 6/1984 | Beekes | |
| 4,486,043 A | | 12/1984 | Rais | |
| 4,603,831 A | | 8/1986 | Krishnakumar et al. | |
| D288,666 S | | 3/1987 | Brun | |
| 4,660,876 A | | 4/1987 | Weldin et al. | |
| 4,804,097 A | | 2/1989 | Alberghini et al. | |
| 4,821,372 A | | 4/1989 | Casiello | |
| 4,842,158 A | | 6/1989 | Reyes, Jr. | |
| D302,527 S | | 8/1989 | Spies | |
| 4,896,913 A | | 1/1990 | Kennedy | |
| D306,142 S | | 2/1990 | Dye | |

(List continued on next page.)

FOREIGN PATENT DOCUMENTS

| | | |
|---|---|---|
| DE | DS 27 20 448 | 7/1978 |
| JP | 47-38064 | 3/1968 |
| JP | 3-236932 A | 10/1991 |
| JP | 5-318563 A | 3/1993 |
| WO | WO 90/05764 | 5/1990 |
| WO | WO 97/43108 | 11/1997 |
| WO | WO 97/44179 | 11/1997 |

OTHER PUBLICATIONS

Kudo, K., *Manufacturing Method of Plastic Container having Integrally Formed Partition,* JP 47–38064, Issued Sep. 26, 1972, Translation by Takamori Technical Translation Services, 4 pages.

*Primary Examiner*—Dean J. Kramer
(74) *Attorney, Agent, or Firm*—Sutherland Asbill & Brennan, LLP

(57) ABSTRACT

A pour and carry device for use in conjunction with relatively large consumer beverage containers. In one embodiment, the device is integral to the container, in another embodiment, the device is separate. One embodiment includes a finger tunnel. In one embodiment, the tonguelike member extends outwardly relative to the bottle neck and downwardly towards the bottle body so as to provide a crotch therebetween to accept the web portion intermediate a human's thumb and forefinger, to allow the human to grip, lift, and pour the bottle by placing the palm on the bottle below but proximate the neck, such that the web portion fits within the crotch, and the thumb and forefinger combine to at least partially surround the neck of the bottle.

8 Claims, 6 Drawing Sheets

SECOND EMBODIMENT

U.S. PATENT DOCUMENTS

| | | | | | |
|---|---|---|---|---|---|
| 4,909,403 | A | | 3/1990 | Reyes | |
| 4,936,614 | A | | 6/1990 | Russell | |
| 4,993,565 | A | | 2/1991 | Ota et al. | |
| D320,350 | S | | 10/1991 | Fabiano | |
| 5,104,010 | A | | 4/1992 | Codorniz et al. | |
| D327,221 | S | * | 6/1992 | Simmons | D9/434 |
| 5,141,120 | A | | 8/1992 | Brown et al. | |
| D329,517 | S | | 9/1992 | Vavla | |
| D329,810 | S | * | 9/1992 | Rastogi | D9/434 |
| 5,165,557 | A | | 11/1992 | Ota et al. | |
| 5,183,169 | A | | 2/1993 | Grzych | |
| 5,269,441 | A | | 12/1993 | O'Meara | |
| D349,241 | S | | 8/1994 | Isaacson | |
| 5,385,277 | A | | 1/1995 | Drew et al. | |
| 5,398,828 | A | | 3/1995 | Valyi | |
| 5,413,231 | A | | 5/1995 | Carroll et al. | |
| 5,487,482 | A | | 1/1996 | Rocheleau | |
| 5,579,937 | A | | 12/1996 | Valyi | |

* cited by examiner

FIRST EMBODIMENT

SECOND EMBODIMENT

THIRD EMBODIMENT

BOTTLE HANDLE AND CARRY ASSIST DEVICE

TECHNICAL FIELD

The present invention generally relates to beverage containers (a.k.a. "bottles"), and particularly relates to a device used to assist a consumer in pouring a large, filled, bottle, or to carry said bottle.

BACKGROUND OF THE INVENTION

Pourable beverage containers, namely containers that are configured to be poured by a user into individual servings, are well known in the art. Some such pourable beverage containers (a.k.a. "bottles") are comprised of plastic, and can be of a variety of shapes and sizes.

One type of pourable beverage container is that of a size approaching two liters, and has proven desired by consumers due to its high capacity and efficiency. Nevertheless, such sized containers due to their size and also to their relative flexibility have been found to prove somewhat unwieldy when being poured from a full configuration, especially by consumers having smaller hands or load carrying capacities. Such unwieldiness often can result in undesirable spilling of the beverage.

Therefore a need has been recognized to alleviate the difficulties noted above.

SUMMARY OF THE INVENTION

The present invention overcomes deficiencies in the prior art by providing a device used to assist a consumer in pouring a large, filled, beverage container, or to carry said beverage container.

Therefore it is an object of the present invention to provide a device which assists a consumer in pouring a large, filled beverage container, or to carry said beverage container.

It is a further object of the present invention to provide an improvement to beverage containers, which provides assistance to users in carrying the beverage container.

It is a further object of the present invention to provide an improvement to beverage containers, which provides assistance to users in pouring the beverage container.

It is a further object of the present invention to provide a beverage container handle and carry assist device which is simple to use.

It is a further object of the present invention to provide a beverage container handle and carry assist device which is simple to use during the pouring process.

It is a further object of the present invention to provide a beverage container handle and carry assist device which is simple to use while carrying the beverage container.

It is a further object of the present invention to provide a beverage container handle and carry assist device which allows for one-handed carrying of one or more beverage containers.

It is a further object of the present invention to provide a beverage container handle and carry assist device which allows for one-handed pouring of one or more beverage containers.

It is a further object of the present invention to provide a beverage container handle and carry assist device which can be manufactured separate from the beverage container.

It is a further object of the present invention to provide a beverage container handle and carry assist device which can be manufactured integral with the beverage container.

It is a further object of the present invention to provide a beverage container handle and carry assist device which tends not to interfere with storage of the beverage container.

It is a further object of the present invention to provide a beverage container handle and carry assist device which tends not to interfere with transportation of the beverage container.

It is a further object of the present invention to provide a beverage container handle and carry assist device which tends not to interfere with filling of the beverage container.

It is a further object of the present invention to provide a beverage container handle and carry assist device which is environmentally sound.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENTS

Reference is now made to the drawings, in which like numerals indicate like elements throughout the several views.

Figure 1:
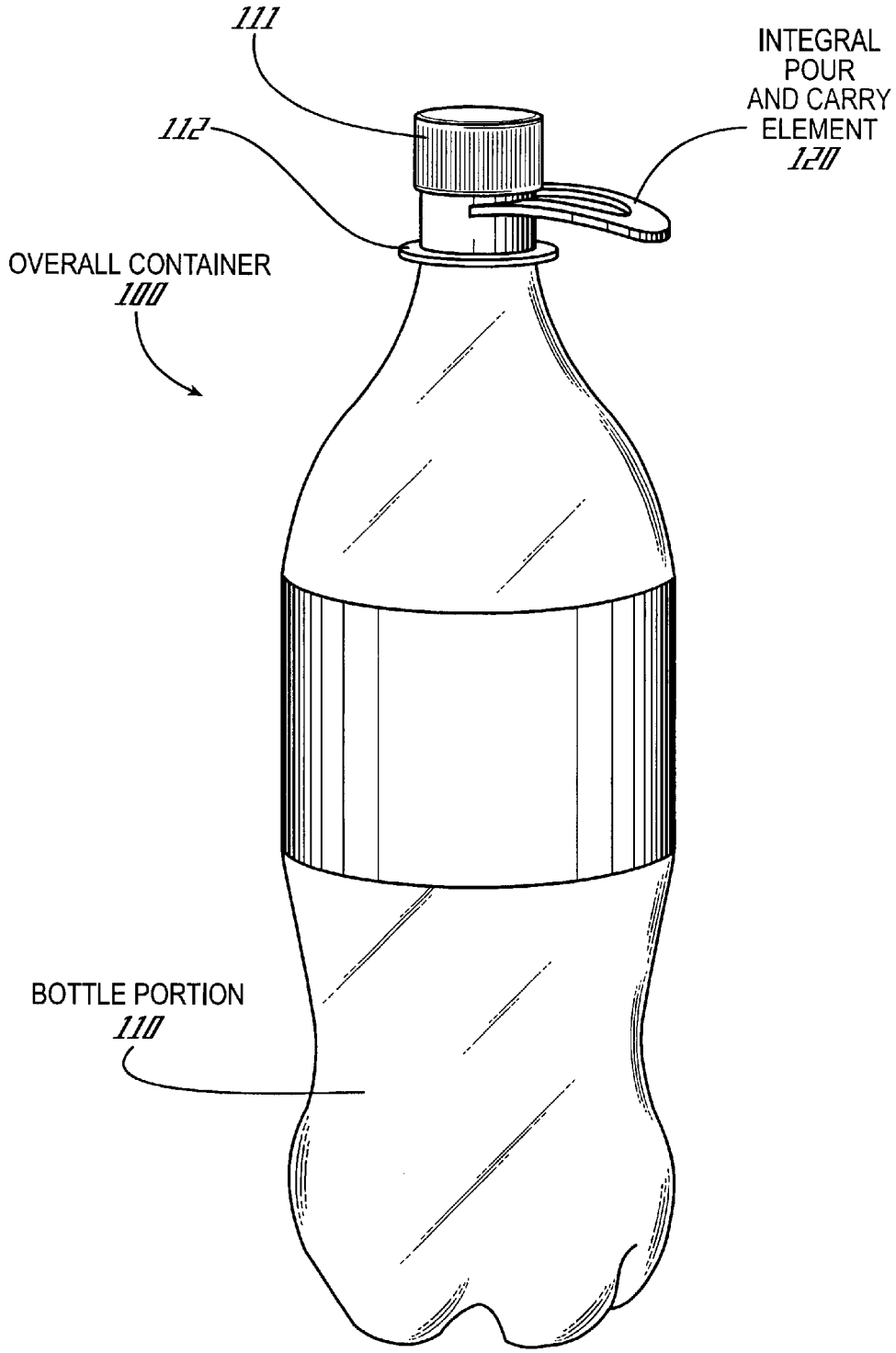
FIG. 1 is a pictorial view of an overall container 100 including a beverage container portion 110 and an integral pour and carry element 120, according to a first embodiment of the present invention.
Figure 2:
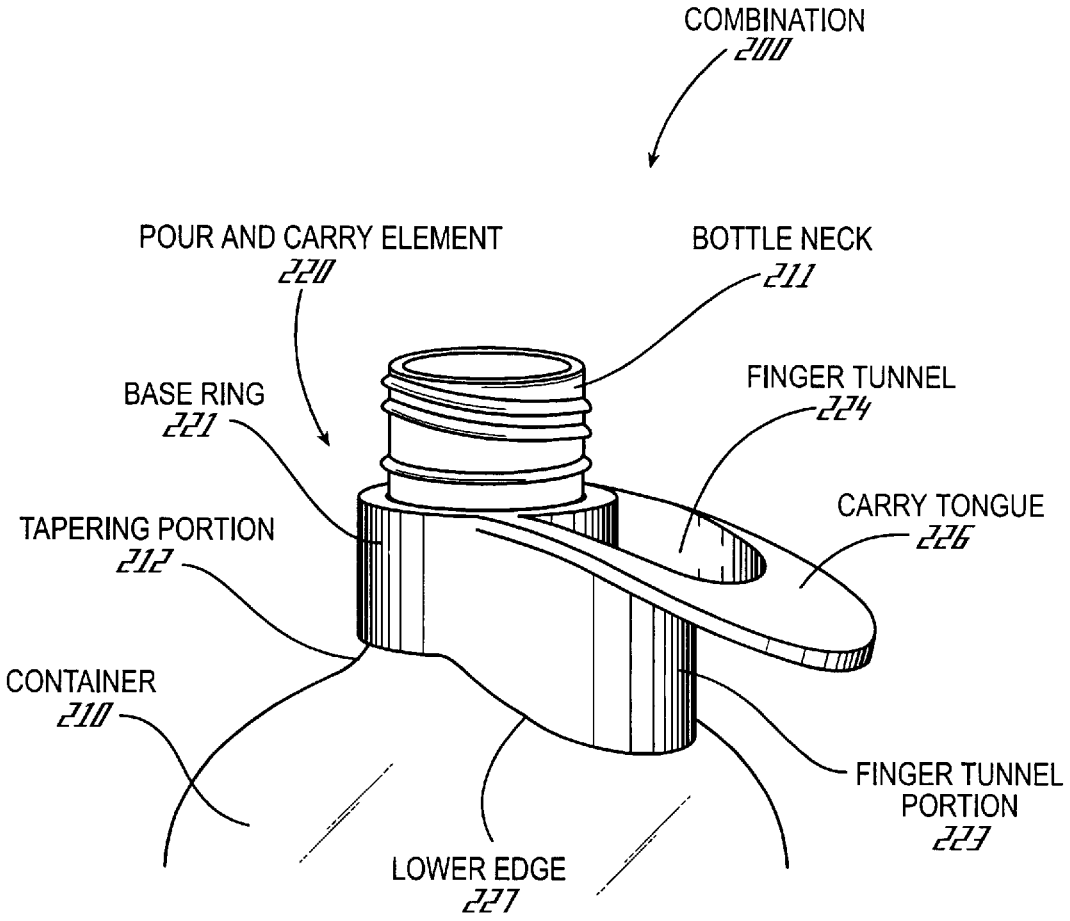
FIG. 2 is a partial view of a second embodiment of the invention, being a beverage container combination 200, including a conventional beverage container 210 and a pour and carry device 220 according to a second embodiment of the present invention.

Generally described, the invention includes three embodiments, a first embodiment shown in FIG. 1, a second embodiment shown in FIG. 2, and a third embodiment shown in FIGS. 3, 4A–4C, and 5. The first embodiment includes a pour and carry device which is integral to the container. The second and third embodiments include a pour and carry element separate from the container.

All embodiments allow for a user to manually grasp the container and the pour and carry device in different manners in order to pour or carry the container.

First Embodiment

FIG. 1 is a pictorial view of an overall container 100 including a container portion 110 and an integral pour and carry element 120, according to a first embodiment of the present invention.

The integral pour and carry element 120 is located just the below the cap 111 of the container portion 110, and is located above the support ring 112, and below the cap 111 location.

The integral pour and carry element 120 is essentially tongue-like in shape, and extends generally sidewardly while slightly curving downwardly. In one preferred embodiment, the length of the tongue may vary but generally will not exceed the major diameter of the overall container 100. The width of the tongue may vary but generally will not exceed the diameter of the support ring.

It may be understood that molding of the integral pour and carry element 120 of the overall container 100 would likely take place at the injection molding stage of the PET bottle production.

Second Embodiment

FIG. 2 is a partial view of a second embodiment of the invention, being a beverage container combination 200, including a conventional beverage container 210 and a pour and carry device 220 according to a second embodiment of the present invention.

The pour and carry device 220 includes the following elements and features:

a base ring 221 a finger tunnel portion 223 a finger tunnel 224 a carry tongue 226 a lower edge 227

The base ring 221 is configured to be positioned about the neck 211 of the container 210. The base ring 221 includes an integral snap ledge (not shown), which provides for a snap-fit configuration on the neck 211 of the base ring 221 as discussed elsewhere.

The finger tunnel portion 223 extends sidewardly and slightly downwardly from one side of the base ring 221. The finger tunnel portion 223 could be thought of as having a generally U-shaped horizontal cross section, with the two ends being attached to the base ring 221.

The finger tunnel portion 223 is configured to define a finger tunnel 224, which extends completely through the pour and carry element 220, when it is in isolation. However, when the pour and carry element 220 is attached to the container 210 a s shown in FIG. 2, the "bottom" of the finger tunnel is blocked by the outside surface of the container 210.

The carry tongue 226 extends sidewardly from the upper edge of the finger tunnel portion 223, in same general direction that the finger tunnel portion 223 extends from the base ring 221. The carry tongue 226 is generally planar in shape, and extends outwardly and slightly downwardly from the finger tunnel portion 223.

The pour and carry element 220 includes a lower edge 227, which is endless, and generally shaped like the outline of a two-segmented peanut. This lower edge is preferably configured to continuously contact the outer, upper, surface of the container 210.

Third Embodiment

FIGS. 3 and 4A–4C illustrate a third embodiment of the invention, namely a pour and carry element 320, which includes a base ring 321, a pair of flange portions 322, a stabilizing skirt 323, a carry tongue 326, and a lower edge 327.

Figure 3:
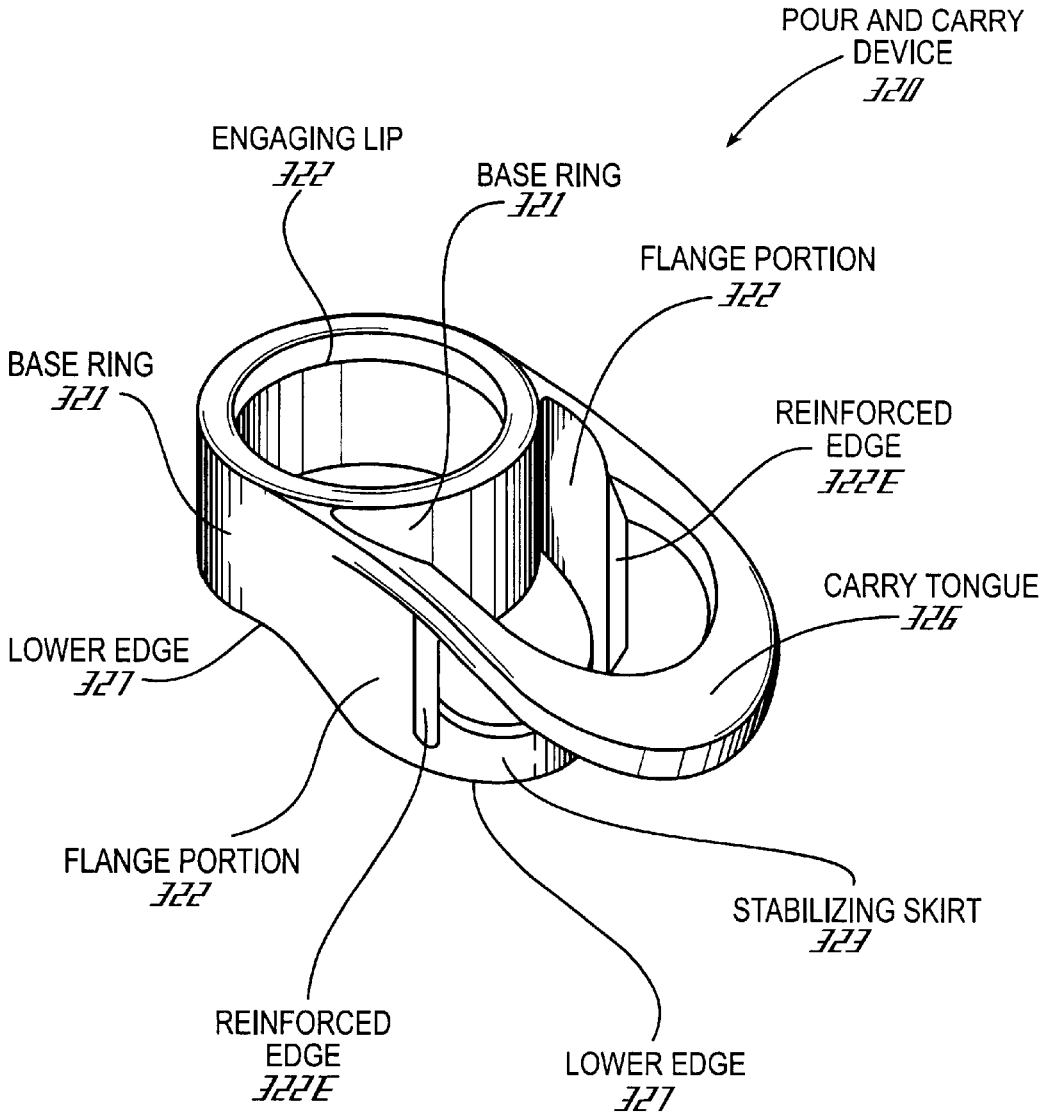
FIG. 3 is an isolated view of a third embodiment of the present invention, being a pour and carry device 320. This device 320 is separate from a conventional beverage container 210, to be part of an overall beverage container combination 300.
Figure 4A:
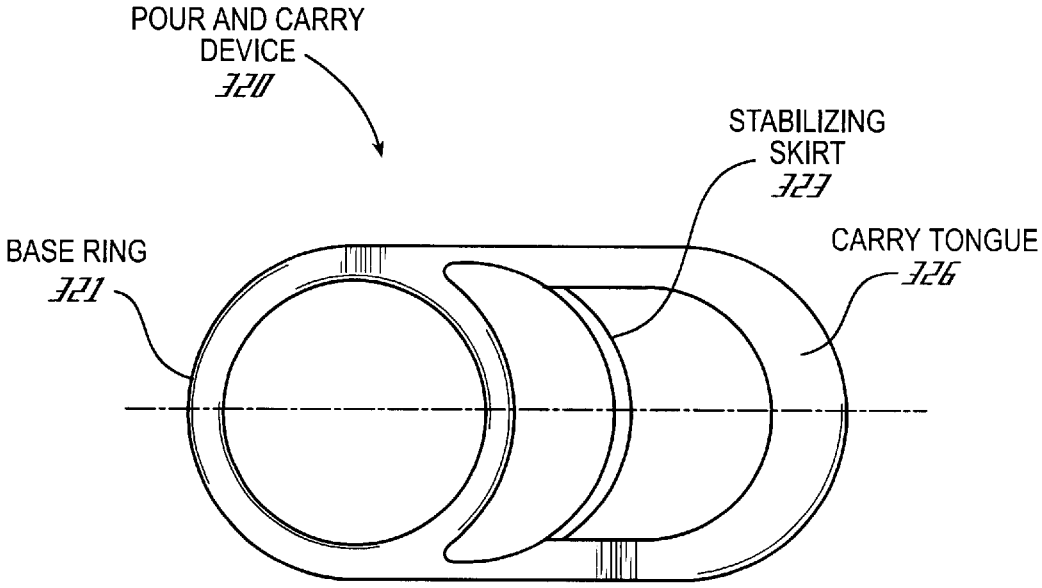
FIGS. 4A, 4B, and 4C, are top, side, and front side elevational views of the third embodiment of FIG. 3.
Figure 4B:
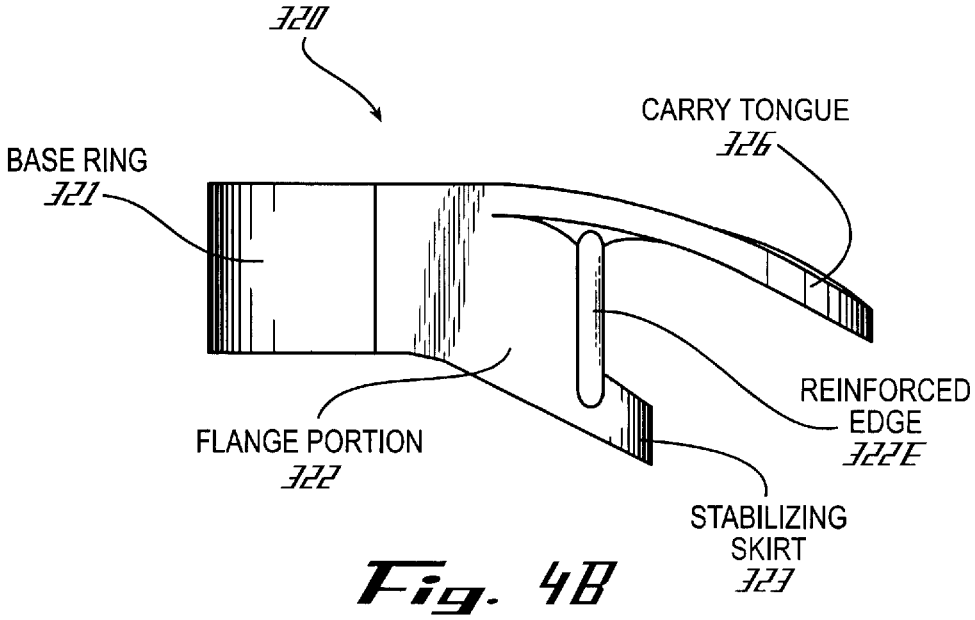
Figure 4C:
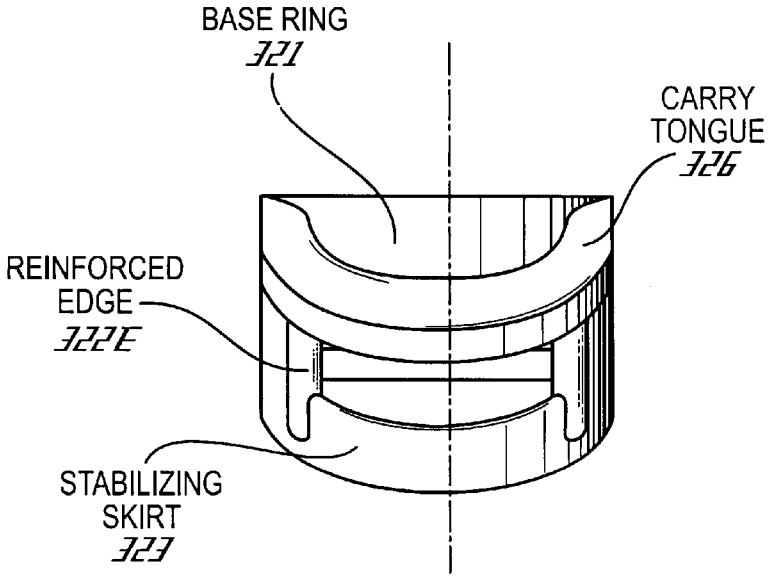

The pour and carry element 320 is shown in isolation in FIG. 3. However, it should be understood that it is configured to fit on a container such as 210 shown in FIG. 2, in the same general manner that pour and carry element 220 is shown fitting atop the container 210. Particularly, the base ring 321 is configured similar to the base ring 221 in order to fit around the neck of a container of the second embodiment member.

Referring again to FIGS. 3 and 4A–4C, the base ring 321 of the pour and carry element 320 is substantially ring-like in shape, and includes an engaging lip 322, which will be discussed in more detail with reference to FIG. 5.

The two flange portions 322 extend to one side of the base ring 321, and tend to curve generally inwardly towards each other as they extend sidewardly away from the base ring 321. A built-up vertical edge 322E is provided on each vertical free edge of the flange portions 322, for strength and to better facilitate or otherwise simplify the manufacturing process, which can include injection molding.

The stabilizing skirt 323 is generally semi-circular in shape, and has each of its extreme ends attached to the lower vertical edge of a corresponding one of the flange portions 323. The stabilizing skirt 323 is, as discussed later, configured to contact the upper surface of a container.

The carry tongue 326 is generally "U"-shaped in configuration, having its ends attached generally atop the upper edge of the flange portions 322. The carry tongue 326, unlike the carry tongue of the second embodiment, defines a open gap between its medial portion and the remainder of the pour and carry element 320. In other words the carry tongue 326 is actually loop-like in shape and nature, in that one could reach one's finger around the carry tongue, grasp the carry tongue, lift it, and generally easily manipulate the pour and carry element 320 along with the remainder of the container.

A lower edge 327 is defined by a combination of the lower edge of the base ring 321 and the stabilizing skirt 323. As in the second embodiment, this lower edge 327 is generally shaped like the outline of a two-segmented peanut.

The stabilizing skirt has its medial portion spaced apart from the base ring 321, such that a through gap is provided between the stabilizing skirt 323 and the base ring 321.

It should be generally understood that the shape of the third embodiment pour and carry device 320 is generally similar in overall shape to the pour and carry device 220 shown in FIG. 2. However, certain materials saving are evident in the FIG. 3 configuration, and the function of the loop-like carry tongue 326 allows one to "hook" one's finger around the carry tongue 326, unlike the carry tongue 226 of FIG. 2, which extends continuously with no gaps from the upper edge of the finger tunnel portion 223.

It should also be understood that the general inclined nature of the carry tongue 326 is similar to that of the carry tongue 226 of the element 220 described above.

Figure 5:
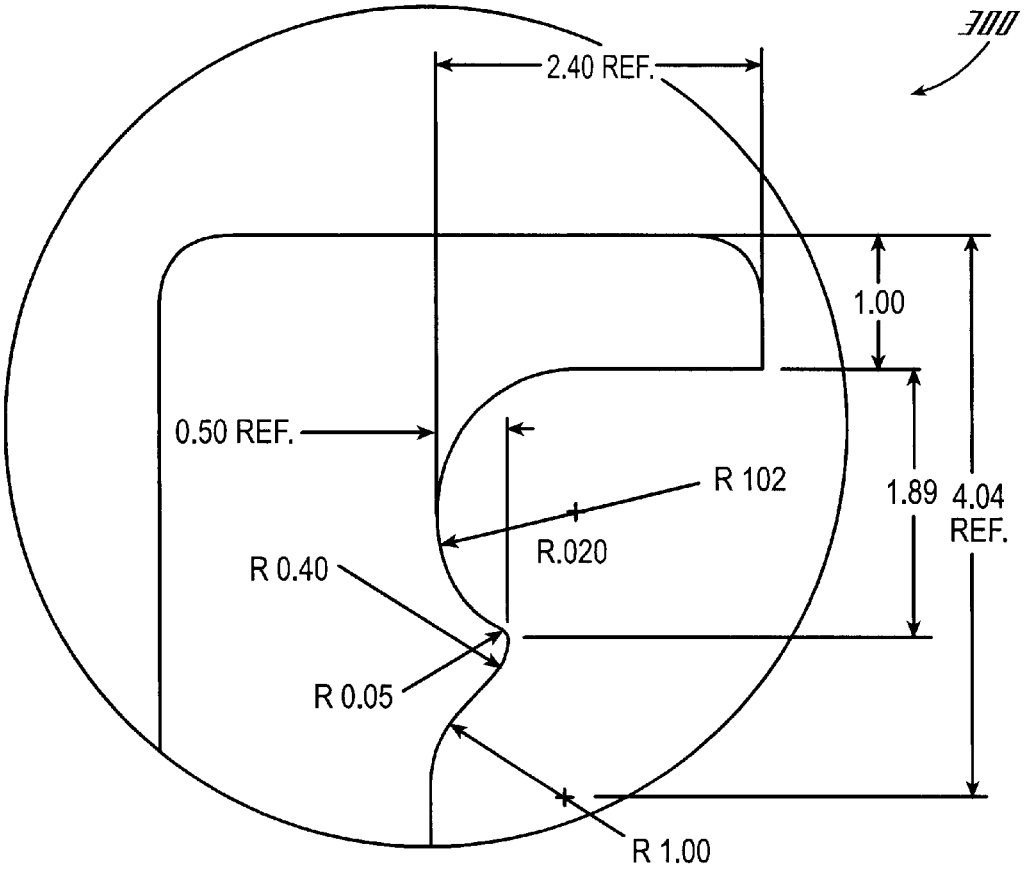
FIG. 5 is an isolated detailed cross-sectional view illustrating a snap ridge, which allows for the snap-on configuration used within the second and third embodiments of the invention. It should be understood that any dimensions shown are only for the purpose of showing the interference fit provided and should not be construed as limiting.

Reference is now to FIG. 5, which illustrates an engaging lip 322, which extends inwardly within the circular inner wall of the base ring 321. As may readily understood this engaging lip 322 is configured to "snap" onto the support ring of the bottle, allowing it be retained thereto. However, it should be understood that this engagement does not necessarily have to be permanent. The present invention contemplates reuse of the pour and carry element 220 with more than one conventional container.

Manufacture

The first embodiment is integral to the preform used to manufacture the container and this no further operation is needed.

The second and third embodiments are envisioned to be applied to the container after filling operation in a simple but automatic snap on operation. This allows for selection of when to use the device. However, under one embodiment of the invention such selectively attachable devices are not intended to be removed once installed.

Use

The invention may be used in various different ways. For example, the tonguelike member can be "hooked" by a finger of a user and carried thereby while the container is filled and closed. In the instance of the second embodiment, which includes a "finger tunnel", said finger tunnel could be used by inserting a finger (e.g., a forefinger) into the tunnel with the palm down, and "hooking" the finger to lift upwardly on the tunnel as the bottle is being poured. The generally "U"-shaped carry tongue 326 of the third embodiment could likewise be so "hooked" during pouring, or during upright carrying.

Figure 6:
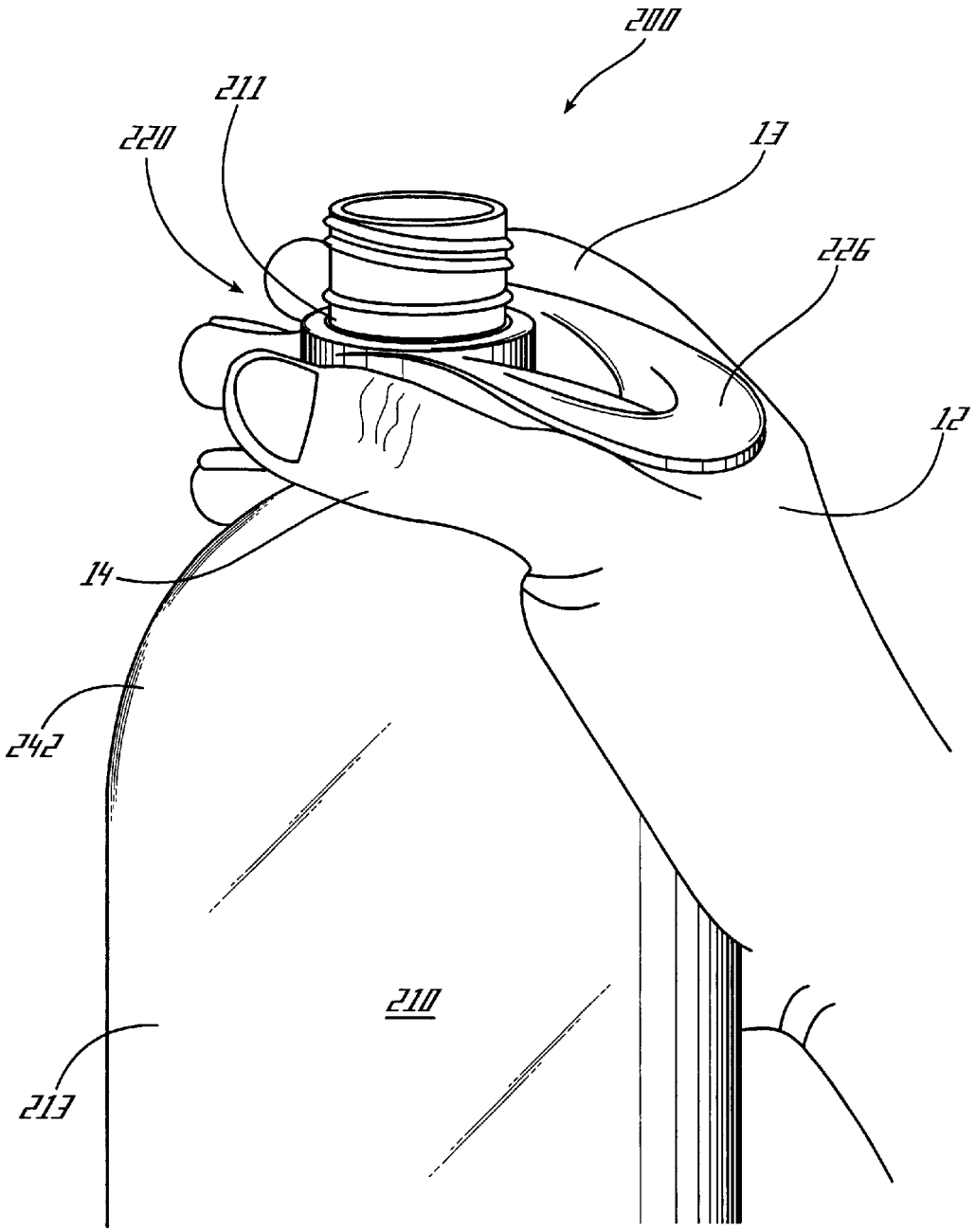
FIG. 6 is a pictorial partial view of the second embodiment of the invention, being a beverage container combination 200, including a conventional beverage container 210 and a pour and carry device 220, as used during a grasping and subsequent pouring process involving a user's hand 12.

One particular manner of using the device is shown in FIG. 6, which is a pictorial partial view of the second embodiment of the invention, being a beverage container combination 200, including a conventional beverage container 210 and a pour and carry device 220, as used during a one-handed grasping and subsequent pouring process involving a user's hand 12. The user's hand 12 includes a forefinger 13 and a thumb 14.

The container 210 in this configuration includes a neck 211 and a tapering portion 212. The tapering portion 212 is intermediate the main body 213 of the container and the neck.

Also referencing FIG. 2, it may be understood that the tonguelike member 226 combines with the finger tunnel portion 223, the base ring 221, and the tapering portion 212 of the bottle to define a hand grip channel configured to accept the "crotch" of the hand 12 of a human user (in this case the right hand), said crotch being intermediate the forefinger 13 and the thumb 14.

In particular, it may be seen that the tonguelike member 226 extends from the neck of the bottle outwardly and downwardly in a gentle curved so as to provide a crotch (in combination with the other side defined by the bottle) to accept the web portion intermediate the human's thumb 14 and forefinger. This allows the human hand 12 to grip the bottle by placing the palm on the bottle below but proximate the neck, such that the curved portion and the tonguelike member combine to define a crotch, with the thumb and forefinger combining to at least partially surround the neck of the bottle.

Materials Used for Separate Elements in Second and Third Embodiments

The materials used can vary greatly, and can include various materials known in the art. For example only, suitable materials can include polypropylene, polyethylene, PET, etc. One anticipated material is post-consumer recycled PET for the benefit of the environment as well as the possibility of recycling the container and handle together, even if initially manufactured separately.

Conclusion

Therefore it may be seen that the present invention provides a beverage container handle and carry device which can be used to assist a consumer in pouring a large, filled, bottle, or to carry said bottle from location to location.

While this invention has been described in specific detail with reference to the disclosed embodiments, it will be understood that many variations and modifications may be effected within the spirit and scope of the invention as described in the appended claims.

What is claimed is:

1. A beverage container having an upper end capable of being filled and emptied, said upper end defining a support ring, comprising:

an integral tongue member extending sidewardly relative to the neck of said beverage container and downwardly relative to said container upper end to about said support ring, said tongue member configured to support the weight of said beverage container when said container is filled and said tongue is manually grasped and lifted.

2. A device for use with a beverage container having an upper end defining an opening capable of being filled and emptied and a neck with a support ring depending downwardly from said upper end, said device comprising:

a base ring for attachment to said neck of said beverage container;

a finger tunnel extending from said base ring; and a tongue member extending sidewardly relative to said base ring and also downwardly relative to said container upper end to about said support ring, said tongue member configured to support the weight of said beverage container when filled;

said finger tunnel and said tongue member configured to support the weight of said beverage container when pouring;

said base ring and said tongue member forming an integral element.

3. The device for use with a beverage container as claimed in claim 2, wherein said base ring and said finger tunnel are part of an integral unit.

4. A gripping and carry device for use with a beverage container having an upper end defining an opening capable of being filled and emptied and a neck with a support ring depending downwardly from said upper end, said device comprising:

a base ring for attachment to said neck of said beverage container;

a pair of flange members extending sidewardly from said base ring;

a stabilizing skirt extending from said flange members; and a tongue member extending sidewardly relative to said base ring and also downwardly relative to said container upper end to about said support ring, said tongue member configured to support the weight of said beverage container when filled.

5. A gripping and carry device for use with a beverage container having an upper end defining an opening capable of being filled and emptied and a neck with a support ring depending downwardly from said upper end towards a body of said container, said device comprising:

a tonguelike member extending outwardly relative to said beverage container neck and downwardly to about said support ring so as to provide a crotch therebetween to accept the web portion intermediate a human's thumb and forefinger, to allow said human to grip, lift, and pour said beverage container by placing the palm on said beverage container below but proximate said neck, such that said web portion fits within said crotch, and said thumb and forefinger combine to at least partially surround said neck of said beverage container;

said beverage container and said tongue member comprising an integral element.

6. The gripping and carry device of claim 5, wherein said tongue is arcuate with the curve towards the body of the beverage container.

7. The gripping and carry device of claim 6, wherein said tongue is integral to said container.

8. The gripping and carry device of claim 6, wherein said tongue is detachable relative to said container.

* * * * *